US005136733A

United States Patent [19]

Church

[11] Patent Number: 5,136,733

[45] Date of Patent: Aug. 11, 1992

[54] BEDPAN

[76] Inventor: Judith A. Church, 24921 Muirlands, #324, El Toro, Calif. 92630

[21] Appl. No.: 431,793

[22] Filed: Mar. 20, 1989

Related U.S. Application Data

[63] Continuation of Ser. No. 88,524, Aug. 21, 1987, abandoned, which is a continuation of Ser. No. 852,163, Apr. 15, 1986, abandoned.

[51] Int. Cl.[5] ..... A61G 9/00

[52] U.S. Cl. ..... 4/456

[58] Field of Search ..... 4/450–457

[56] References Cited

U.S. PATENT DOCUMENTS

| | | | |
|---|---|---|---|
| 884,842 | 4/1908 | Nelson | 4/455 |
| 1,169,101 | 1/1916 | Hogan | 4/450 |
| 1,499,161 | 6/1924 | Farnsworth | 4/450 |
| 1,888,423 | 11/1932 | Comper | 4/450 |
| 2,139,273 | 12/1938 | Jones et al. | 4/450 |
| 2,359,830 | 10/1944 | Deckert | 4/450 X |
| 2,611,903 | 9/1952 | Wakeman | 4/450 |
| 2,886,827 | 5/1959 | Washington | 4/456 |
| 3,084,348 | 4/1963 | Parker et al. | 4/456 |
| 4,368,548 | 1/1983 | Glass | 4/450 X |

FOREIGN PATENT DOCUMENTS

| | | | |
|---|---|---|---|
| 14322 | of 1890 | United Kingdom | 4/456 |
| 13374 | of 1901 | United Kingdom | 4/456 |
| 322738 | of 1928 | United Kingdom | 4/450 |

*Primary Examiner*—Charles E. Phillips
*Attorney, Agent, or Firm*—Saul Epstein

[57] ABSTRACT

A bedpan for use by bedridden patients which includes a shallow pan appropriately shaped to fit under a patient's buttocks. The top of the pan is partially covered with a flexible sheet which holds the patient's weight and provides a significantly improved comfort as compared with the prior art hard surfaced tops.

13 Claims, 1 Drawing Sheet

FIG. 1.
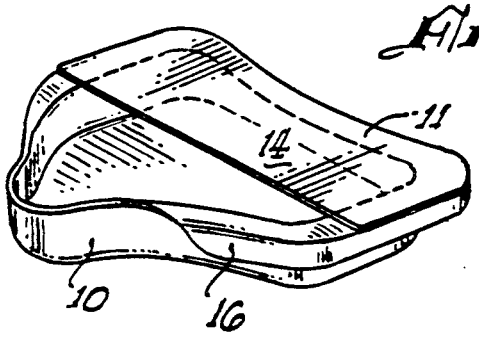
FIG. 5.
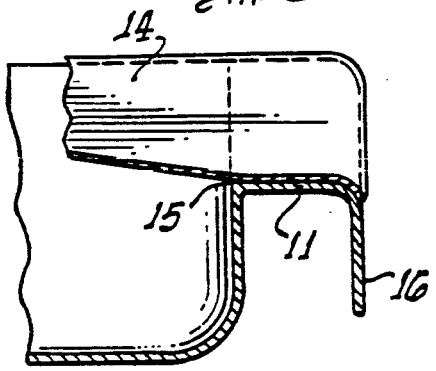
FIG. 2.
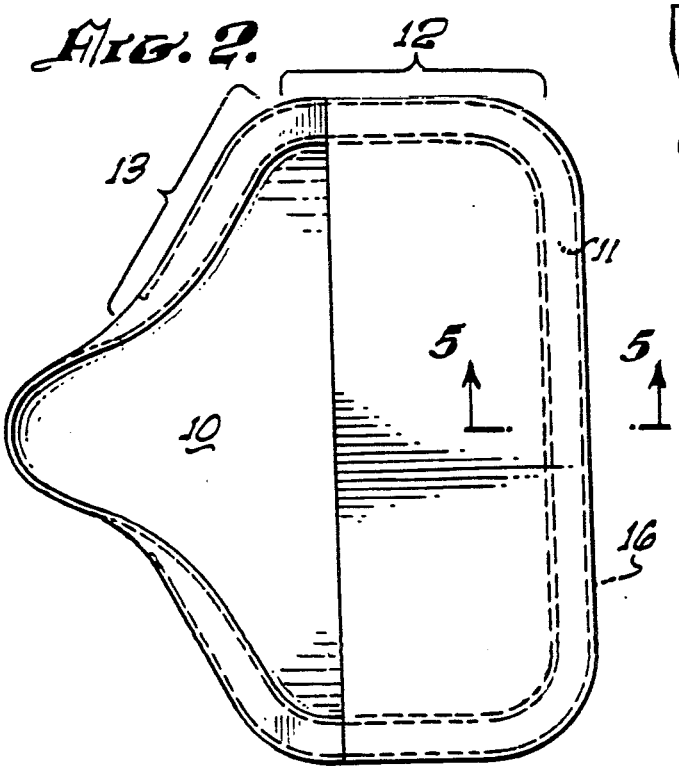
FIG. 4.
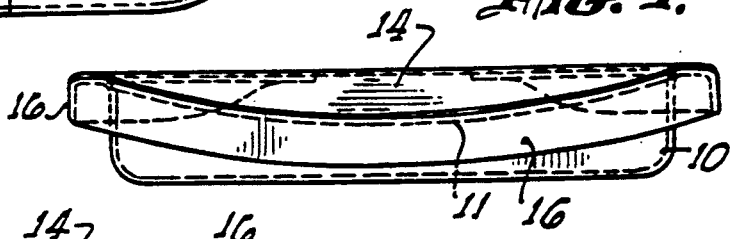
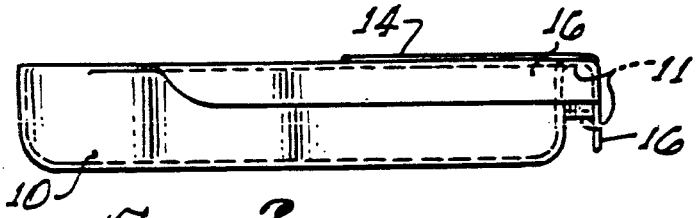
FIG. 3.

BEDPAN

This is a continuation of application Ser. No. 07/088,524 filed on Aug. 21 1987, now abandoned, which is a continuation of application Ser. No. 852,163 filed on Apr. 15, 1986, now abandoned.

BACKGROUND OF THE INVENTION

1. Field of the Invention

This invention relates to bedpans for use by hospital patients or other bedridden persons.

2. Prior Art

A traditional bedpan for use by bedridden patients is comprised of a shallow hard plastic or metal open topped pan having a relatively wide rim on which the patient rests during use. While the rim is generally contoured, or even in some cases padded so as to reduce patient discomfort, at best prior art bedpans are uncomfortable and disagreeable to use.

Accordingly, it is an object of the present invention to provide a bedpan which is substantially more comfortable for the patient than prior art bedpans.

SUMMARY OF THE INVENTION

The present invention is comprised of a shallow pan of appropriate shape having a relatively narrow top rim and preferably molded from a hard plastic material. Instead of the usual wide rim which is found in prior art bedpans, the present invention provides a sheet of flexible plastic or rubberlike material across a portion of the top opening on which the patient rests his or her hips. The plastic hip support readily conforms to the shape of the patient's body and provides a relatively large support area so that the patient's comfort is substantially enhanced.

A more complete understanding of the invention can be had from the following detailed description.

BRIEF DESCRIPTION OF THE DRAWINGS

FIG. 1 is a perspective view of a bedpan according to the present invention.

FIG. 2 is a top plan view of the invention.

FIG. 3 is a left side view of the invention.

FIG. 4 is a rear view of the invention.

FIG. 5 is a cross sectional view taken at 5—5 of FIG. 2.

DETAILED DESCRIPTION OF THE INVENTION

The invented bedpan is preferably molded from a hard plastic material, but can be fabricated from metal if desired. The pan portion 10 is relatively shallow and includes a flat lip 11 at the back and in the other areas of the pan which will come into contact with a patient's body. The pan is relatively wide where the patient's hips and upper buttocks area is supported (12) but narrows down in the area 13 so that the patient's thighs will be outside the pan. The area at the top of the patient's thigh just below the buttocks rests on lip 11.

The lip 11 at the rear of the bedpan is contoured downward as can be seen in FIG. 4 to generally fit the contour of a patient's body at the hips. A sheet of flexible plastic or rubberlike material 14 is stretched tightly across the top of the pan 10 and is sealed to the lip 11. The sheet 14 extends sufficiently over the open top of the pan so that the majority of a patient's weight can be supported thereby, and relatively little need be supported on the rim 11. By providing a large flexible area to support the patient's hips and top portion of the buttocks, namely sheet 14, comfort is substantially enhanced.

The attachment of sheet 14 to lip 11 can be accomplished either by heat sealing or by use of an adhesive. Corner 15, the intersection of sheet 14 with the pan proper should either be sharp in the area covered by the sheet, or if radiused, should be filled with some filler material so that no crevice remains where foreign matter can lodge.

Lip 11 in the presently preferred embodiment disclosed herein is shown extending outward from the pan, however, an alternate construction with the lip extending inward is also possible, as also is a lipless construction wherein the sheet 14 is sealed to the pan 10 on the vertical sidewall. In order to achieve the latter described construction, sheet 14 may be a molded piece having a downwardly extending periphery which can be attached to the sidewall of pan 10.

The turned down edge 16 is an optional feature which is useful for grasping the bedpan to position it under the patient, or for carrying. It may or may not extend into the area 13, as desired.

What has been described is a novel bedpan for use by bedridden persons which is much more comfortable than prior art bedpans. Various modifications within the spirit of the invention will no doubt occur to those skilled in the art and such are intended to be covered hereby. The proportions of the various elements in the preferred embodiment disclosed are shown for illustrative purposes only and are not meant to be limitations of the invention, the scope of which is to be measured solely by the following claims.

I claim:

1. A bedpan comprising:

a) a shallow open topped pan having a bottom and a surrounding sidewall; and b) flexible weight supporting sheet means conformable to the shape of a patient's body for supporting the patient's hips and upper buttocks area and for spreading the load on the patient's body attached to said pan, said flexible sheet covering a portion of the open top area of said pan, at least a portion of the supporting area of said flexible sheet being spaced from the bottom and sidewalls of said pan.

2. A bedpan as recited in claim 1 where said flexible sheet is attached to a substantially horizontal lip on said sidewall of said pan at the top thereof.

3. A bedpan as recited in claim 2 wherein said lip extends outward of said pan.

4. A bedpan as recited in claim 1 wherein the top of said sidewall has a downwardly curved region to roughly conform with the curvature of a patient's back area in the region of his or her hips.

5. A bedpan as recited in claim 4 where said flexible sheet is attached to a substantially horizontal lip on said sidewall of said pan at the top thereof.

6. A bedpan as recited in claim 5 wherein said lip extends outward of said pan.

7. A bedpan comprising:

(a) a shallow open topped pan having a bottom and a surrounding sidewall; and (b) means for supporting a patient's hips and upper buttocks attached to said pan at the open top of said pan, said means comprising a flexible sheet stretched across the open top of said pan, substantially all of the weight of the patient being supported by said sheet and coupled to said pan through tension in said sheet.

8. A bedpan as recited in claim 7 where said flexible sheet is attached to a substantially horizontal lip on said sidewall of said pan at the top thereof.

9. A bedpan as recited in claim 8 wherein said lip extends outward of said pan.

10. A bedpan as recited in claim 7 wherein the top of said sidewall has a downwardly curved region to roughly conform with the curvature of a patient's back area in the region of his or her hips.

11. A bedpan as recited in claim 10 where said flexible sheet is attached to a substantially horizontal lip on said sidewall of said pan at the top thereof.

12. A bedpan as recited in claim 11 wherein said lip extends outward of said pan.

13. A bedpan as recited in claim 7 where said sheet is fabricated from a material selected from the group consisting of flexible plastic and rubberlike materials.

* * * * *